US006174047B1

(12) United States Patent
Tavernier et al.

(10) Patent No.: US 6,174,047 B1
(45) Date of Patent: Jan. 16, 2001

(54) METHOD FOR ELECTRO (STATO) GRAPHIC PRINTING ON LARGE FORMAT SUBSTRATES

(75) Inventors: Serge Tavernier, Lint; Luc Van Aken, Kuringen; Leo Vackier, 's-Gravenwezel; Guido Desie, Herent, all of (BE)

(73) Assignee: Xeikon N.V., Mortsel (BE)

( * ) Notice: Under 35 U.S.C. 154(b), the term of this patent shall be extended for 0 days.

(21) Appl. No.: 08/929,065

(22) Filed: Sep. 15, 1997

Related U.S. Application Data

(60) Provisional application No. 60/032,945, filed on Dec. 9, 1996.

(30) Foreign Application Priority Data

Oct. 17, 1996 (EP) ..... 96202893

(51) Int. Cl.[7] ..... B41J 2/06
(52) U.S. Cl. ..... 347/55
(58) Field of Search ..... 347/55, 154, 103, 347/123, 111, 159, 127, 128, 17, 141, 120, 151, 155; 399/271, 290, 291, 293, 294, 295

(56) References Cited

U.S. PATENT DOCUMENTS

| | | |
|---|---|---|
| 4,845,519 | 7/1989 | Fuse . |
| 5,136,334 | 8/1992 | Camis et al. . |
| 5,305,026 | 4/1994 | Kazuo et al. . |
| 5,453,768 | 9/1995 | Schmidlin . |
| 5,561,503 | 10/1996 | Masuda . |
| 5,691,757 * | 11/1997 | Hayashihara et al. ..... 347/155 |

FOREIGN PATENT DOCUMENTS

| | | |
|---|---|---|
| 90 13 772 U | 1/1991 | (DE) . |
| 0 247 248 A1 | 12/1987 | (EP) . |
| 61-145649 | 9/1986 | (JP) . |

OTHER PUBLICATIONS

Patent Abstracts of Japan, vol. 10, No. 346 (M–537) , Nov. 21, 1986 and JP 61 146564 A, Jul. 4, 1986.

Patent Abstracts of Japan, vol. 1, No. 353 (M–539) , Nov. 28, 1986 and JP 61 152463 A, Jul. 11, 1986. (Oki Electric Ind Co Ltd).

Patent Abstracts of Japan, vol. 5, No. 147 (M–88) , p. 64, (Oki Electric Ind Co Ltd) ., JP 56077167 A.

* cited by examiner

*Primary Examiner*—John Barlow
*Assistant Examiner*—Raquel Yvette Gordon
(74) *Attorney, Agent, or Firm*—Knobbe, Martens Olson & Bear LLP

(57) ABSTRACT

A method for printing an image on a substrate by image-wise depositing, toner particles on the substrate, is disclosed, comprising: image-wise depositing dry toner particles on the substrate forming a first band-like portion of the image, conditioning the first band-like portion while keeping the substrate at a temperature equal to or lower than 100° C. and further image-wise depositing toner particles on the substrate so as to form at least one other band-like portion of such image, the at least one other band-like portion of the image being adjacent to the first band-like portion. Preferably the method is used for printing substrates with an area equal to or larger than 0.25 $m^2$.

16 Claims, 1 Drawing Sheet

METHOD FOR ELECTRO (STATO) GRAPHIC PRINTING ON LARGE FORMAT SUBSTRATES

This is a continuation of provisional application Ser. No. 60/032 945, filed Dec. 9, 1996, now expired.

FIELD OF THE INVENTION

This invention relates to a method for printing images on a substrate by depositing toner particles on the substrate. In particular, but not exclusively, it relates to a method for printing large area images by depositing charged toner particles on a substrate via electrostatic or magnetic latent image bearing members.

BACKGROUND OF THE INVENTION

Printing methods wherein toner particles are used to form an image present several advantages. The printing method is a dry method—in case dry toner particles are used—and the toner particles, comprising a resin can be tailored so as to give weatherproof images, etc. Other printing methods, e.g. ink-jet printing, thermal printing, etc., show, when compared to toner printing, one or more deficiencies. Up until now, large format printing, using ink-jet is a well known technique, but the inks used in the printing, show often problems with weatherability, especially regarding the water-fastness. Therefore, in large format printing, e.g. poster printing, billboard printing, wherein the weatherability of the print is very important, silk-screen printing is still a dominant printing method. This method has however its own drawbacks. The method is rather time consuming since for every colour a dedicated screen has to be made and printed and the method is basically analogue.

More and more images to be printed are available in digital form, so that also in the printing of large formats, digital addressable printing techniques become indispensable. The use of toner based systems in such printing techniques is however not so straightforward. All toner depositing means available today, be it electrophotographic means or direct electrostatic means, are at least in one direction as large as the substrate to be printed. This means that in printing on substrates where the dimensions are measured in meter instead of in centimetre, as in, e.g., billboard printing, the toner depositing means must be very large (page-wide), since the printing speed equals intrinsically the speed of the digital printing process in the direction perpendicular to said page-wide array.

In direct electrostatic printing, this means that a very large array of printing apertures has to be provided, wherein each of the apertures has to be addressed separately. Moreover, the distance of said printing apertures to the substrate to be printed has to be controlled within tight limits, thus complicating the construction of a printer.

In electrophotography, ionography or magnetography, wherein an electrostatic or magnetic latent image is developed by dry toner particles and the developed image transferred to the substrate, a very wide latent image bearing member, without minute flaws that can deteriorate the image quality must be provided. Providing a large printer with such a latent image bearing member increases the costs of it to an almost unacceptable level. In case dry toning particles are used, the stable supply of toner particles to the development zone poses problems. The use of page wide applicators, e.g. based on magnetic brush assemblies is technically difficult to achieve, due to the small tolerances that are needed in the toning process.

Nevertheless, the use of the dry toning particles might have a very high value in large format printing, since they have a low ecological impact in comparison to ink-jet, liquid toning systems, and even the classical ink based systems as used in offset printing, gravure printing or screen printing.

The use of dry toner based imaging technology to create output with a size larger than the size of the imaging units (toner depositing means) themselves, in both dimensions, has only scarcely been addressed in the past. In the UK-patent application GB-A-2 106 453, there is disclosed an electrophotographic printer based on the use of a small printhead, comprising as well a photoconductive drum and basic stations such as a charging unit, an imaging unit, a toning unit and a cleaning unit, said printing head enabling the toning of plain, normal paper supported on a backing plate. Said device is described as an electrophotographic printer of the contactless type. It is described to be suitable for the creation of different, complex characters, whereas it is described to contain one line of characters as working width, leaving however open the possibility that more than 1, e.g. 2 lines can be printed in one single pass. Possible extension to colour is mentioned. Another reference to a dry toner based imaging method implicitly capable of creating larger size images can be found in the document "Shuttle print head, a TONERJET fact sheet" published by Array Printers AB, Sweden, (1995), TONERJET is a trade name of Array Printers. In this document an analogy is made between ink-jet printing and tonerjet printing. A process currently used in ink-jet printing, namely using the shuttling of the print head or print array is substituted by the shuttling of a toner jetting print head or print head array. The same mechanism is used, enabling the contactless projection of the toning material, in order to create images. This disclosure regarding direct electrostatic printing does not address the problem of keeping the distance between the printhead structure and the substrate within tight limits.

In the case of the electrostatic printing as disclosed in GB-A-2 106 453, the problem of image deterioration when the transfer of the toner particles from the latent image bearing member to the substrate is done in contact mode has not been addressed and moreover said GB application is concerned with providing an extremely small printing device.

In JP-A-61 146564 a serial printer is disclosed comprising pressure means to press a pressure receiver on a picture-bearing material for transferring and fixing the picture developed on the picture-bearing member to a recording material. The advantage of this design is that there is no external force necessary to move the recording paper.

In JP-A-61 152463 a serial electrophotographic printer is disclosed with a carriage including an image holding body, an electrification unit , an exposure unit, a toner and a developing unit. The carriage moves over an image receiving member that is larger than the carriage and band-like portions of the image are printed on the image receiving member and after the printing of several bands, the image is fixed. Also in DE-90 13 772 U such a type of serial printer has been disclosed. In such a serial printer, wherein the image is printed in band by a carriage moving over the image receiving member in a direction perpendicular to the direction of movement of the image receiving member through the printer, the image receiving member stops during the printing of a band and moves after the printing of a first band to the position wherein a second band is printed and so on. The fixing unit, being installed over the total width of the image receiving member (i.e. over the dimension of the image receiving member perpendicular to the movement of it), and operating continuously fixes stronger when the image receiving layer is stopped for printing a band than when the receiving layer moves. Thus the fixing does not proceed evenly which can result in a deterioration of the image quality.

Therefore, serial printer wherein the carriage includes also means for fixing the image have been disclosed. In, e.g., JP-A-61 145649 a serial electrophotographic printer is disclosed with a carriage including an image holding body, an electrification unit, an exposure unit, a developing unit, a toner and a developing unit and a fixing unit. Also JP-A-56 077167 discloses such a printer. In these printers, due to the different pressure exerted on the image receiving member by the image holding body (a photoconductive drum) and the fixing roller the image receiving member, the risk exist that the image receiving member becomes wrinkled, and—due to this wrinkling—that the transport of the receiving member does no longer proceed smoothly.

In U.S. Pat. No. 5,561,503 a serial printer with a carriage including an image holding body, an electrification unit, an exposure unit, a developing unit, a toner and a developing unit and a fixing unit is disclosed, wherein by a special design of the carriage and the bearing of he fixing unit, the problem of the wrinkling is avoided.

However, in a printer according to U.S. Pat. No. 5,561,503, the temperature of the image receiving substrate can be high, since fixing temperatures of toner particles are easily around 120° C. and even around 150° C. This heating of the substrate can result in dimensional changes of the substrate, e.g., an expansion or a shrinkage in the first band that is printed and whereon the image is fixed. When this occurs the exact registration of the band to be printed adjacent to the first band is difficult and even impossible. Even a limited mis-registration between the bands that are printed does deteriorate the image quality that can be achieved with the printer. This is especially so when full-colour prints have to be made.

Therefore further improvements, to make the techniques mentioned above suitable for printing with high image quality, both in small format printing and in large format printing are needed.

OBJECTS OF THE INVENTION

It is an object of the invention to provide a printing method using toner particles, wherein the toner depositing means are smaller than both dimensions of the substrate to be printed, making it possible to print images with high spatial resolution with high speed.

It is a further object to provide a printing method making it possible to print large format images by image-wise depositing toner particles with high resolution and high speed.

Further objects and advantages of the invention will become clear from the detailed description hereinafter.

The objects of the present invention are realised by providing a method for printing an image on a substrate by image-wise depositing, toner particles on said substrate comprising the steps of:

image-wise depositing toner particles on said substrate forming a first band-like portion of said image, conditioning said first band-like portion while keeping said substrate at a temperature equal to or lower than 100° C., further image-wise depositing toner particles on said substrate so as to form at least one other band-like portion of said image, said at least one other band-like portion of said image being adjacent to said first band-like portion and fixing said image to said substrate.

In a preferred embodiment said toner particles are dry toner particles deposited from an electrostatic or magnetographic latent image bearing member whereon a developed latent image is present or an intermediate toner receiving member whereon a toner image is present, said developed latent image or said toner image being transferred to said substrate in contact mode.

In a further preferred embodiment said first band-like portion of said image is conditioned before said at least one other band-like portion of said image is deposited.

DEFINITIONS

Figure 1:
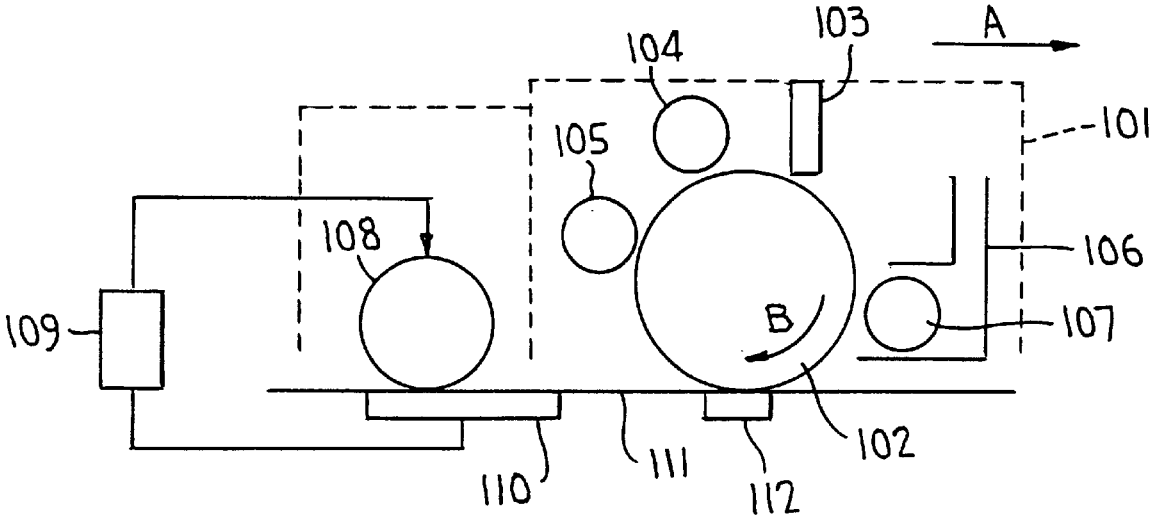
FIG. 1 shows a schematical view of a shuttle for use in a printer performing the method of this invention.

In this disclosure, the wording "adjacent band-like portions" is used to mean band-like portions each with one edge very closely (leaving a small gap, i.e. a gap smaller than 1 mm, preferably smaller than 0.250 mm) deposited near to or in exact contact with at least one edge of the adjacent portion as well as to mean band-like portions each with at least one edge that has a small overlap (at most 10% of the dimension of said band-like portion measured perpendicular to the edge that overlaps) with at least one edge of the adjacent portion.

In this disclosure, the wording "toner depositing means" is used to indicate the means for image-wise depositing toner particles especially dry toner particles to the substrate.

DETAILED DESCRIPTION OF THE INVENTION

When at least a part of the toner depositing means contacts the substrate whereon the printing proceeds, said toner depositing means contacts, in most cases, while printing further band-like portions of the image, the previously deposited band-like portion and risks to deteriorate the already deposited toner image.

Therefore it is preferred that the portions of the image that are printed are conditioned as the deposition of said image portions proceeds. This conditioning results in making the deposited portions of the image insensitive to damage caused by the mechanical contact between the toner depositing means and said deposited image portions while a further portion of the image is deposited.

It was found that the printing quality of printing devices using dry toner particles, wherein the means for depositing toner are smaller than both dimensions of the substrate to be printed, could be enhanced when, for forming an image, dry toner particles were deposited on said substrate forming a first band-like portion of said image, and said first band-like portion is conditioned in such a way that said substrate is at any time of the process kept at a temperature equal to or lower than 100° C. When several bands of the image are printed, then a final fixing step is executed to finally fix the image to the substrate. It was found that by printing by such a method, the risk of deteriorating the already deposited, but unfixed toner image,—as in some of the prior art methods,—is avoided. And by keeping the temperature during the conditioning of the toner image low, the risk of dimensional changes of the substrate, e.g., an expansion in the first band that is printed, —as with other prior art methods, is also avoided.

This conditioning at low temperature has the advantage that the method can be used with image receiving materials that have a support with a heat distortion temperature lower than 150° C. Thus the usefulness of the printing method using a serial printer is enhanced.

The conditioning, in a method according to this invention, can proceed during the multiple subsequent contacts occurring when depositing one band-like image portion. These multiple subsequent contacts in one band, occur in case that several layers of toner particles are superposed in, e.g., full colour printing or in monochrome printing wherein multiple layers of different toner particles are superimposed to extend the printable density levels, such a monochrome printing has been disclosed in EP-A-768 577. When proceeding in this way the first band-like portion can be conditioned to such an extent that a further conditioning between the deposition of said first band-like portion of the image and a further adjacent portion is not necessary. This conditioning is furtheron called "conditioning within". The conditioning of the first band-like portion can also proceed before or during the deposition of an adjacent band-like image portion. This conditioning is furtheron called "conditioning between". In a preferred embodiment said conditioning is both a conditioning within a band and between bands.

The conditioning can be either thermal, electrostatic or mechanical or a combination thereof.

Although the type of conditioning used for conditioning within and/or for conditioning between image can be of any type, it is preferred to combine different types of conditioning such as a thermal conditioning in combination with an electrostatic conditioning, the latter proceeding during the deposition of a band-like image portion (conditioning within), the former proceeding before the deposition of further adjacent band-like portions of the image (conditioning between) Thermal conditioning, results in the adhering of the toning particles to each other and to the substrate, in such a way that the already deposited image portion become insensitive to possible damage caused by the mechanical contact between the toner depositing means and said deposited image portions while a further portion of the image is deposited. It has been found however that said thermal conditioning, in a printing method according to the present invention, has to be performed in a very specific way, such as that the substrate never reaches a temperature higher than 100° C. in the mass. If this temperature is exceeded too much moist evaporation and thermal deformation takes place, whereby the dimensional stability of the receptor is lost. This leads to mis-registering between the different adjacent bands to be printed. In a further preferred embodiment the heat is supplied by flash fusing, whereby the toning particles and the upper surface of the substrate are heated sufficiently to gently fuse the particles and adhere them to the surface, but whereby the overall temperature of the mass, (after the flash) does not exceed 100° C. Further a cold backing plate can be used in order to withdraw thermal energy. In another possible embodiment the substrate is coated with a receptive coating allowing adherence at low temperature, either by offering softening and/or wetting properties. Said coating can be applied either on-line in the printer device or off-line on the substrate. The thermal conditioning can also proceed by other means, e.g., using hot air, taking special measures in order to cool the substrate and using it in a short time frame. The conditioning station can pass over the band after the deposition of the image in an individual way, or can be associated with the last deposition station, or can be integrated in more complex subsystems containing all used toning stations.

In an other embodiment of a printing method according to this invention, the conditioning of the already deposited portions of the image can be done using electrostatic phenomena. The already deposited toned image is treated with a flux of ionised material, such as e.g. ions generated from a corona device, etc. By doing so the charge of the toning particles is changed from their initial value. In a preferred embodiment the toner particle are charged to a polarity and also a magnitude of charge such that the particles already deposited do not become picked up by the contacting toner depositing means, e.g., a photoconductor. This can be done by increasing their charge so that in the next deposition step they remain or become strongly bound to the substrate. In a preferred embodiment, where an electrostatic latent image bearing member, e.g., a photoconductor, is used as toner depositing means, this portion of the toner depositing means contacting the previous band, e.g., the photoconductor edge, can be charged and/or illuminated in such a way that it gives rise to a strong repulsive field, pressing electrically the particles to the substrate, and not allowing disturbance of the already deposited image.

Also a pressure conditioning can be used. In this case a pressure roller is pressed over the deposited image, pressing the toning particles together and in the surface of the substrate. This process can be effected by using a steel roller and some backing roller, exerting pressure when rolling over the surface of the receptor. Here again some receptive layer coated on the receptor can be used in a preferred embodiment. Coating can be applied off-line or on-line.

In a method according to this invention, the temperature of the image receiving member can be monitored by any temperature sensing means known in the art. The reading of this temperature sensing means is used to control the conditioning so that in the substrate the temperature of 100° C. is never exceeded. Therefore the readings are coupled by a feed back loop to the means for conditioning the band-like portion and if necessary to means for cooling the image receiving substrate. Said means for cooling can in this invention be a cooling plate at the back-side of the image receiving substrate, a fan blowing cold air over the substrate, etc.

The printing method according to the present invention is especially useful when large format printing has to be performed. By large format printing is meant the printing on a substrate having an area equal to or larger than 0.25 $m^2$.

The toner depositing means used in the method according to this invention, is preferably an electrostatic latent image bearing member or magnetographic latent image bearing member or an intermediate toner receiving member, whereon a toner image is deposited and from which said toner image is deposited on said substrate. On said intermediate toner receiving member, the toner image can be deposited from a latent image bearing member or by direct electrostatic printing as described in, e.g., EP-A-743 572.

When the toner depositing means is a latent image bearing member or an intermediate toner receiving member it is preferred that said toner depositing means contacts, e.g., by rolling contact, sliding contact, etc., the substrate over whole the surface to be printed; i.e. the transfer of the toner image to the substrate proceeds in contact.

The toner depositing means used in the method of this invention, can also be a direct electrostatic printing device (a DEP device) as described in e.g. EP-A-675 417, EP-A-712 056, etc. In this case the toner depositing means itself does not contact the substrate to be printed, but it proved beneficial that in this case the toner depositing means is provided with mechanical means to keep the distance between toner depositing means and the substrate constant. Said mechanical means are in contact with the substrate, e.g., by rolling or sliding contact.

When the toner depositing means is an intermediate member, it is possible, in a method according to this invention, to image wise apply toner particles to said intermediate member by means of an electrostatic or magnetic latent image bearing member or by a DEP (Direct Electrostatic Printing) device. Suitable electrostatic printing devices, for use in a method according to this invention, are disclosed in, e.g., EP-A 675 417, EP-A 712 056, etc.

In an apparatus for performing the method according to the present invention, the toner depositing means is preferably a "shuttle", i.e. the toner depositing means can be moved in a controlled way over the surface of the substrate to be printed. When said "shuttling" toner depositing means comprises a latent image bearing member or an intermediate toner image bearing member, it is preferred that the means necessary to bring toner on the latent image bearing member or on the intermediate member shuttle together with said toner depositing means and are located at fixed positions with respect to the toner depositing means. E.g. when the shuttling toner depositing means is an electrophotographic latent image bearing member, this latent image bearing member is surrounded by cleaning means, a charging unit, an exposure unit and a toner source, each of these being located in a fixed position with respect to said latent image bearing means and shuttling together with said latent image bearing member without any change in the relative positions of said latent image bearing member, said cleaning means, said charging unit, said exposure unit and said toner source with respect to each other.

In FIG. 1 a schematic view is given of a device for performing the method of this invention with printing band-like portions and "conditioning within" with conditioning means. A shuttle or carriage (101) moves over a image receiving substrate (111) in the direction of arrow A. The shuttle includes a photosensitive drum (102) moving in the direction of arrow B surrounded by means (104) for charging said drum, means (103) for image-wise exposing the drum, a container for toner particles (106) with a development roller (107) therein, and means for cleaning the photosensitive drum (105). The shuttle further comprises means for conditioning (108). A temperature sensor (110) senses the temperature of the image receiving substrate and by a feed back loop (109) the temperature of the image receiving substrate is kept below 100° C. Means for producing a backing potential (112), for enhancing the toner transfer from the photosensitive drum to the image receiving substrate, are coupled to the toner depositing means so as that both can be moved together without relative displacement between both said means for producing said backing potential and said toner depositing means.

The conditioning means (108) in an apparatus for implementing the method of this invention can comprise, as said above, means for thermal conditioning. These thermal means can be IR radiators, a flash, hot air, etc. The conditioning means (108) in an apparatus for implementing the method of this invention can also comprise, as said above, means for conditioning the deposited band-like portion by electrostatic phenomena. These means include means for creating a flux of ionised material, e.g. a corona or a backing roller (not shown in FIG. 1). The conditioning means (108) in an apparatus for implementing the method of this invention can also comprise, as said above, means for conditioning the deposited band-like portion by pressure, in that case conditioning means (108) is a pressure roller. The conditioning means (108) can comprise a combination of means for thermal conditioning and means for electrostatic conditioning. It can also comprise a combination of means for thermal conditioning and means for mechanical conditioning The feed back loop (109) can be connected to the conditioning means (108) and in case these means are means for thermal conditioning, the feed back loop can be used to adjust the energy out-put of the means for thermal conditioning. The feed back loop (109) can be connected to means for cooling the substrate (111), e.g. can be used to drive a fan.

The backing potential (112) behind the substrate creates an electrical field attracting the toner particles to the substrate to be imaged. This can be done either by a uniform backing pattern, or a more localised electrical connection, such as a backing roller or bar or brush or ion emitting device such as a corona, a scorotron, etc.

Figure 2:
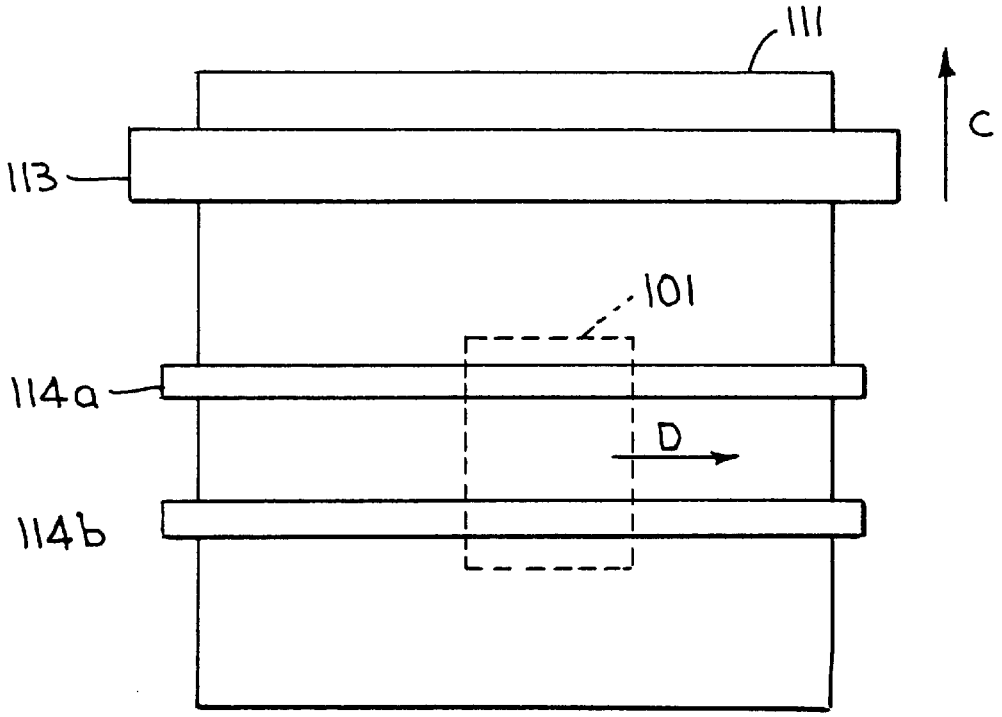
FIG. 2. Shows schemattically how a shuttle as shown in FIG. 1 can be incorporated in a printer performing the method of this invention.

In FIG. 2, it is very schematically shown how the shuttle, shown in FIG. 1, can be used in a printer for performing the method of this invention. The shuttle (101) can be moved (by a motor that is not shown in FIG. 2) over guides (114*a* and 114*b*) in the direction of arrow D. This movement is essentially perpendicular to the movement of the image receiving substrate (111) that is moved in the direction of arrow C. The image receiving substrate is passed through fixing station (113) before the final image is ready.

In a printer for performing the method of this invention, the image is thus printed in bands by a carriage (101) moving over the image receiving member in a direction perpendicular (arrow D) to the direction of movement (arrow C) of the image receiving member (111) through the printer, and the image receiving member stops during the printing of a band and moves after the printing of a first band to the position wherein a second band is printed and so on. The fixing unit (113), is installed over the total width of the image receiving member (i.e. over the dimension of the image receiving member perpendicular to the movement of it), and is operating continuously. Basically this is a printer with a configuration as described in the prior art, a.o. in JP-A-61 152463 and DE-90 13 772 U that both have been discussed in the background art section. In these prior art printers the fixing was found to be uneven and deterioration of the image quality was observed. It was surprisingly found that, in a printer for performing the method of this invention, although have a fixing station that is operated as in the prior art printers, the problem of uneven fixing and image quality deterioration, did not occur or did only occur in a very low degree, probably due to the conditioning of the bands during their deposition.

Thus the present invention also encompasses a printing device comprising:

i) means for moving toner depositing means over a substrate along a first dimension of said substrate, wherein at least a part of said toner depositing means contacts said substrate, such as to image wise deposit toner as a first band-like portion of an image to be printed, ii) means for moving said substrate substantially in a way perpendicular to said first direction, iii) means for moving said toner depositing means so as to image-wise deposit toner as at least one further band-like portion of said image to be printed adjacent to said first band-like portion, iv) means for conditioning said image wise deposited toner particles either while depositing said band-like portion of said image (conditioning within) or after depositing said first band-like portion and before depositing said at least one further band-like portion of said image to be printed (conditioning between), while keeping said substrate at a temperature equal to or lower than 100° C. and v) means for fixing said image wise deposited toner to said substrate.

Such a printing device according to the present invention is especially well suited for printing substrate large area's, i.e. substrates with an area larger than 0.25 $m^2$.

The toning particles used in the present invention can be incorporated in a liquid developer as well as in a dry developer. Preferably the method of the present invention is performed with dry toner particles in a dry developer The toner particles can be from different nature, whereby they can be present in the toning station solely as is the case in mono-component developers or in combination with carrier particles as is the case with 2-component, or can be electrically charged colloidal particles as is the case in liquid developers. Depending on the nature of the developer the conditioning can be adapted. The charge of the toner particles can be obtained either by tribo-electrical phenomena between the toner particles or between the toner particles and any other body, such as e.g. the carrier particles in the case of 2-component developers, or tribo-electric friction with doctor blade or application roller as is the case in mono-component-developers. The toner particles can be colourless, monochrome or coloured, may have additional functionalities, can be pigmented or coloured by dyes, by inorganic pigments, ceramic pigments, magnetic or non-magnetic in nature, etc.

The toner particles can be manufactured by different techniques such as classical melt kneading, pulverising and classification, polymerisation, coagulation, etc. Whereas the form, method of production, etc. of the toner particles for use in the present invention can be any form or method known in the art, the properties of the toner particles are to be designed in a very proper way, with respect to charge, size and thermal visco-elastic properties, in order to be of use in the present invention. With respect to size it is found that too small particles give rise to rather inefficient transfer and hence induce unstable image quality.

Since the image is built from the combination of adjacent bands, stochastic transfer instabilities give a very unattractive image quality in the joint (where edge of adjacent band-like portions of the image are deposited closely together or in a small overlap). If the size of the particles is too large, they give rise to problems in order to get appropriate conditioning and adherence to the receptor. The fusing is bad since the flow of heat within the large particle is more difficult. Also the large size will induce higher contact with the image deposition station, and hence larger disturbance. It is found that the toner particles, useful in the method according to this invention, have preferably a size expressed in $d_{v50}$ ($\mu$m) between 3 and 20 $\mu$m, more preferably between 5 and 15 $\mu$m, even more preferably between 6 and 10 $\mu$m. With respect to charge also boundary conditions are important. If the charge is too low the transfer is unstable. When the charge is too high, the particle induces a too large image force on any contacting member, and tends to adhere to said member, giving rise to image disturbance. Hence the charge (in $\mu$C) to mass (in g) ratio of the toner particles, useful in a method according to this invention is, in absolute value $|q/m|$, between 3 and 30 $\mu$C/g, more preferably between 5 and 25 $\mu$C/g even more preferably between 7 and 20 $\mu$C/g.

Also for the visco-elastic properties boundary conditions are found. Since the thermal treatment of a large substrate is done, as well in the general fusing step as possibly in intermediate thermal conditioning steps, the dimensional stability of the substrate poses some problems. If the temperature is too high a deformation can occur, leading to mis-registration and even leading to failure of the smooth substrate movement, resulting in faults, wrinkling, etc. Therefore it is important that the fusing characteristics of the toning particles are adapted for lower thermal treatment. If has been found that a melt viscosity ($\eta$) at 120° C., measured at 100 rad/sec of larger than 2,000 Pa.s starts to pose problems, therefore toner particles with a melt-viscosity lower than 1,000 Pa.s are preferred. On the other hand too low melt-viscosity will result in too long waiting time before the partially imaged substrate can be handled. Therefore the melt-viscosity of the toner particles is preferably larger than 50 Pa.s, preferably 100 Pa.s. Thus the melt-viscosity of toner particles used in the present invention fulfils the equation $50\ \text{Pa.s} \leqq \eta \leqq 2{,}000\ \text{Pa.s}$ and preferably it fulfils the equation $100\ \text{Pa.s} \leqq \eta \leqq 1{,}000\ \text{Pa.s}$.

A printing device according to the present invention is especially well suited for printing substrate large area's, i.e. substrates with an area larger then 0.25 $m^2$.

What is claimed is:

1. A method for printing an image on a substrate by image-wise depositing, toner particles on said substrate comprising the steps of:

image-wise depositing toner particles on said substrate forming a first band-like portion of said image, conditioning said first band-like portion while keeping said substrate at a temperature equal to or lower than 100° C. and further image-wise depositing toner particles on said substrate so as to form at least one other band-like portion of said image, said at least one other band-like portion of said image being adjacent to said first band-like portion and fixing said image to said substrate.

2. A method according to claim 1, wherein said step of image-wise depositing toner particles on said substrate for forming a first band-like portion of said image includes using dry toner particles.

3. A method according to claim 2, wherein said step of image-wise depositing toner particles includes using dry toner particles having an average volume diameter $d_{v50}$ between 5 and 15 $\mu$m.

4. A method according to claim 2, further comprising using a DEP (Direct Electrostatic Printing) device for depositing said toner.

5. A method according to claim 1, wherein said step of conditioning said first band-like portion includes said conditioning proceeding by thermal means.

6. A method according to claim 5, further comprising the step of easuring said temperature of said substrate and adjusting said thermal conditioning to said measured temperature.

7. A method according to claim 1, wherein said step of conditioning said first band-like portion includes said conditioning proceeding by electrostatic means.

8. A method according to claim 7, wherein said electrostatic means of said step of conditioning are selected from the group consisting of a flux of ionized material and an electrical backing roller.

9. A method according to claim 1, wherein said step of conditioning said first band-like portion includes said conditioning proceeding by a combination of electrostatic and thermal means.

10. A method according to claim 1, wherein said step of conditioning said first band-like portion includes said conditioning proceeding by a combination of thermal and mechanical means.

11. A method according to claim 1, wherein said step of image-wise depositing toner particles includes using toner particles having a melt-viscosity n, such that 50 Pa.s $\leqq \eta \leqq$2, 000 Pa.s.

12. A method according to claim 1, wherein said step of image-wise depositing toner particles includes toner particles having a charge to mass ratio |q/m| such that 3 $\mu$C/g$\leqq$|q| $\leqq$30 $\mu$C/g.

13. A method according to claim 1, further comprising printing said image on a substrate having an area of at least 0.25 $m^2$.

14. A printing device comprising:

i) means for moving a means for depositing toner particles over a substrate along a first dimension of said substrate, wherein at least a part of said means for depositing toner particles contacts said substrate, such as to image wise deposit toner as a first band-like portion of an image to be printed, ii) means for moving said substrate substantially in a way perpendicular to said first direction, iii) means for moving said means for depositing toner particles so as to image-wise deposit toner on at least one further band-like portion of said image to be printed adjacent to said first band-like portion, iv) means for conditioning said image wise deposited toner particles while depositing said band-like portion of said image and after depositing said first band-like portion and before depositing said at least one further band-like portion of said image to be printed and v) means for fixing said image wise deposited toner to said substrate.

15. A printing device comprising:

i) means for moving a means for depositing toner particles over a substrate along a first dimension of said substrate, wherein at least a part of said means for depositing toner particles contacts said substrate, such as to image wise deposit toner as a first band-like portion of an image to be printed, ii) means for moving said substrate substantially in a way perpendicular to said first direction, iii) means for moving said means for depositing toner particles so as to image-wise deposit toner on at least one further band-like portion of said image to be printed adjacent to said first band-like portion, iv) means for conditioning said image wise deposited toner particles while depositing said band-like portion of said image after depositing said first band-like portion and before depositing said at least one further band-like portion of said image to be printed and v) means for fixing said image wise deposited toner to said substrate.

16. A printing device comprising:

i) means for moving a means for depositing toner particles over a substrate along a first dimension of said substrate, wherein at least a part of said means for depositing toner particles contacts said substrate, such as to image wise deposit toner as a first band-like portion of an image to be printed, ii) means for moving said substrate substantially in a way perpendicular to said first direction, iii) means for moving said means for depositing toner particles so as to image-wise deposit toner on at least one further band-like portion of said image to be printed adjacent to said first band-like portion, iv) means for conditioning said image wise deposited toner particles while depositing said band-like portion of said image and after depositing said first band-like portion and before depositing said at least one further band-like portion of said image to be printed and v) means for fixing said image wise deposited toner to said substrate.

* * * * *